US005222260A

United States Patent [19]

Piper

[11] Patent Number: 5,222,260

[45] Date of Patent: Jun. 29, 1993

[54] TOILET COVER CLOSURE DEVICE

[76] Inventor: Dean E. Piper, 17268 N.E. 7th Pl., Bellevue, Wash. 98008

[21] Appl. No.: 723,910

[22] Filed: Jul. 1, 1991

[51] Int. Cl.[5] ..... A47K 13/10

[52] U.S. Cl. ..... 4/246.1; 4/246.2; 16/303; 411/34; 411/344

[58] Field of Search ..... 4/246.1, 246.2, 246.3, 4/246.4, 246.5, 243.1, 234, 236, 242.1; 16/303; 411/34, 340, 344, 347

[56] References Cited

U.S. PATENT DOCUMENTS

| | | | |
|---|---|---|---|
| 1,907,826 | 5/1933 | Kapp | 4/249 |
| 1,967,104 | 7/1934 | Sorrow, Jr. | 4/236 |
| 3,063,089 | 11/1962 | Greenman | 16/303 |
| 3,093,220 | 6/1963 | Modrey | 411/34 X |
| 3,781,924 | 1/1974 | Davis, Jr. | 4/246.2 |
| 4,319,365 | 3/1982 | Bemis et al. | 4/236 |
| 4,367,569 | 1/1983 | Harmon | 411/340 X |
| 4,402,092 | 9/1983 | Smallwood | 4/240 |
| 4,491,989 | 1/1985 | McGrail | 4/246.1 |
| 4,494,273 | 1/1985 | Straus | 16/303 X |
| 4,639,147 | 1/1987 | Schwarz | 4/240 X |
| 4,912,783 | 4/1990 | Shafer | 4/246.1 |
| 4,914,757 | 4/1990 | Johnson | 4/224 |
| 5,058,216 | 10/1991 | Trayer et al. | 4/246.2 |

FOREIGN PATENT DOCUMENTS

| | | | |
|---|---|---|---|
| 0531962 | 6/1958 | Italy | 4/246.1 |

*Primary Examiner*—William A. Cuchlinski, Jr.
*Assistant Examiner*—W. Morris Worth
*Attorney, Agent, or Firm*—Richard C. Litman

[57] ABSTRACT

Disclosed is a toilet seat cover closure device responsive to the flow of water in a toilet tank during a flushing operation to operate a push pin to urge the cover from a substantially vertical position to a horizontal position over a toilet seat on a toilet bowl. In a first embodiment the push pin is operated by a bowden wire in response to the pressure of water filling the water tank. In a second embodiment the push pin is operated by a cable arrangement responsive to the lowering of the water in the toilet tank during the first part of the flushing operation. With both embodiments a dampening mechanism is provided to control the rate of descent of the cover, comprising a spring-biased cam element cooperating with cam faces on the cover pivot shaft connected to move with said cover. Also disclosed are quick release fasteners involving deformable elastic members which lock or release the toilet seat and the toilet seat cover to or from the toilet bowl without the need for tools, whereby the toilet seat and toilet cover may be quickly and easily removed for cleaning or replacement.

8 Claims, 4 Drawing Sheets

TOILET COVER CLOSURE DEVICE

BACKGROUND OF THE INVENTION

1. Field of the Invention

This invention relates to a device for closing a toilet seat cover, activated by the flushing of the toilet, and more particularly to a closure device which automatically lowers a fully raised toilet seat cover in a controlled manner when the user thereof actuates the flushing handle.

For safety reasons, it is desirable to have the toilet seat cover and seat in a closed position after use to prevent small children, pets and household articles from falling into the toilet. Even adults may be subjected to inconvenience, trauma, possible injury, and understandable irritation in attempting to use a toilet in the dark, thinking the seat is down when it is not. Additionally, it is esthetically desirable to have the toilet seat and cover in a closed position when not in use. The present invention provides a means for automatically closing the toilet seat cover upon activation of the toilet flushing lever, thereby insuring that both the seat and cover are in a closed position when not in use.

2. Description of Related Prior Art

Toilet seat cover closing devices are well known in the prior art. Also well known in the prior art are counterbalancing devices whereby the lowering of the seat and/or cover is at a controlled rate to minimize noise and/or damage to the seat and/or cover.

U.S. Pat. No. 1,907,826 issued May 9, 1933 to David Kapp discloses a mechanical arrangement actuated by the toilet flushing lever for releasing a catch holding a toilet seat cover in the open position, thereby allowing the toilet seat cover to fall in a controlled manner to the closed position, the control structure comprising a cam rotatable with the cover and acting against a leaf spring. There is no disclosure therein of water pressure or flow being used to initiate closure of the cover.

U.S. Pat. No. 4,402,092 issued Sep. 6, 1983 to Larry L. Smallwood discloses a spring mechanism for toilet seats which uses both a torsion spring and a friction clutch to lower a toilet seat from an upright position at a controlled rate of angular velocity. No structure is disclosed to automatically lower the seat and cover upon flushing of the toilet.

U.S. Pat. No. 4,491,989 issued Jan. 8, 1985 to John F. McGrail discloses a closure device which automatically releases and lowers a toilet seat or the seat and its associated cover together when the flushing handle of a commode or toilet is actuated. The device includes a releasable hinge-closing mechanism having a spring-biased latching lever and a dampening device mounted to the toilet cover. When the latching lever is actuated by the flushing of the commode, the seat or the seat and cover together are released and will move downwardly in a controlled manner by means of the dampening device. A latching pawl is located between the cover hinge member and the seat, whereby the seat and cover are coupled together when in a raised position so as to be lowered together upon being released. The dampening device comprises a cylinder member having means to move air from one chamber to another under pressure, thereby allowing the cover to be lowered at a controlled rate.

U.S. Pat. No. 4,639,147 issued Jan. 27, 1927 to Edward L. Schwarz discloses a friction pivot assembly which may be used with a toilet bowl lid to keep it from inconveniently falling down. The dampening structure includes friction bushings. There is no disclosure by Schwarz of any mechanical means to close the toilet lid.

U.S. Pat. No. 4,912,783 issued Apr. 3, 1990 to Steven E. Shafer discloses a toilet lid closing device for use on toilets of the type having a vertical tank with a flushing lever, a bowl, a seat and an overlying lid. As disclosed, a cable activated by the toilet flushing lever releases a locking means holding the lid upright, and an air cylinder provides a dampener controlling the lowering of the lid.

U.S. Pat. No. 4,914,757 issued Apr. 10, 1990 to Ortiz W. Johnson discloses an automatic toilet lid/seat control device which locks the lid or lid and seat in the upright position when in use and automatically lowers them gently when flushed. Dampening is achieved by means of a fluid cylinder connected to the lid, which starts its descent in response to operation of a flushing handle which depresses a flush rod connected to the lid.

SUMMARY AND OBJECTS OF THE INVENTION

None of the above-cited patents disclose a cover-closing arrangement that is responsive to water flowing from the toilet tank or to water pressure resulting from water flowing into the toilet tank subsequent to activation of the flushing handle.

It is an object of this invention to provide a toilet cover closure device which is automatically activated in response to the flushing of the toilet.

It is a further object of this invention to provide a toilet cover closure device wherein the lowering of the cover is at a controlled rate of angular velocity.

These and other objects are achieved by providing a piston-actuated flexible rod located inside the water storage tank. When the toilet is flushed, water is released from the water storage tank to flow into the toilet bowl. Subsequently thereto, a float valve is opened to initiate the inflow of fresh water from a water source. A portion of the inflowing water is diverted into a pipe having a water release valve and piston. The piston is connected to a flexible rod, the other end of which is connected to collapsible hinged rods located outside of the water storage tank. When the piston is actuated by water pressure to move the flexible rod, the hinged rods are collapsed, moving a push pin on a central pivot thereof outwardly from the storage tank to bear against and move the toilet cover towards the closed position. A spring bears against the piston to return the piston, the flexible rod and the collapsible rods to the home position after the float valve returns to the closed position. The velocity rate of closure of the toilet cover is controlled by means of a spring-loaded cam damper. As an alternative embodiment, the collapsible rods may be coupled by means of a cable-and-pulley system to a sealed container serving as a float within the tank. As the toilet is flushed, the water drains out of the tank into the toilet bowl, allowing the float to descend, which in turn pulls on the cable to collapse the vertically disposed collapsible rods. The central pivot of the vertically disposed collapsible rods bears against the cover to start the cover moving towards the closed position in a controlled fashion.

Other objects, features and advantages of this invention will become apparent from the following detailed description and the appended claims, reference being had to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also, it is to be understood that the phraseology and terminology employed herein is for the purpose of description and not limitation.

Figure 1:
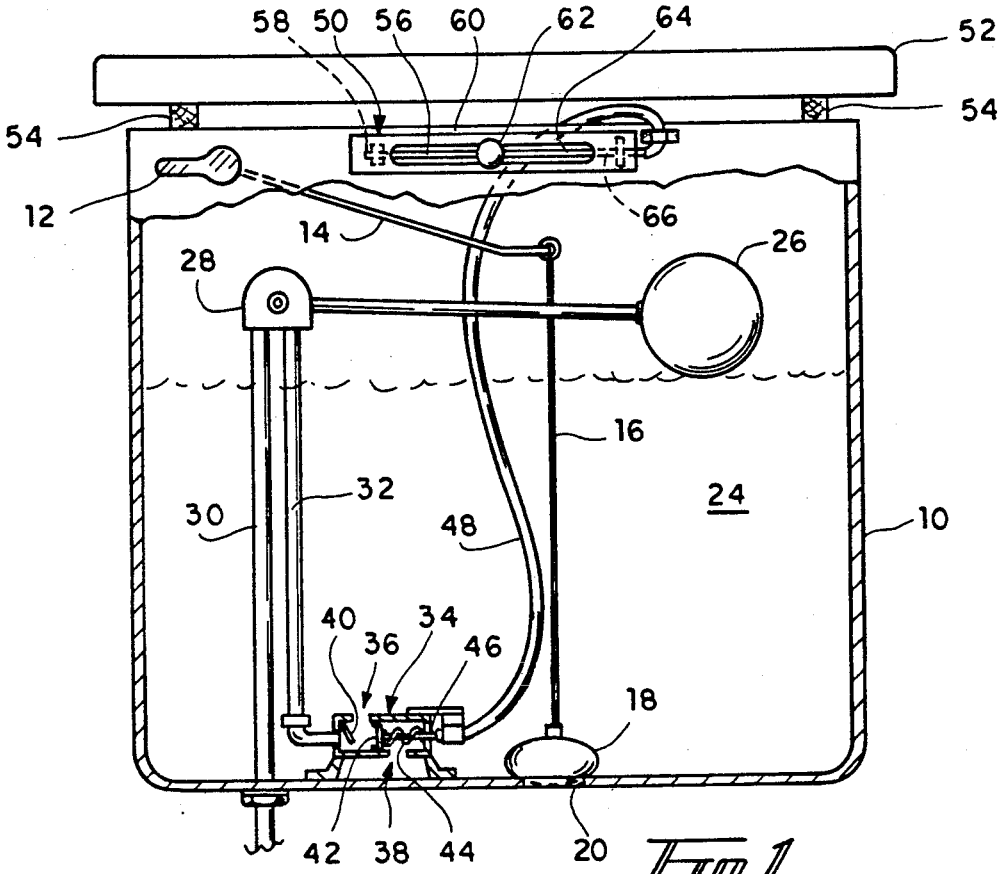
FIG. 1 is a partial cross-sectional front view of a toilet tank showing the flushing mechanism coupled to a toilet cover closure device.

FIGS. 1-6, inclusive, show one preferred embodiment of the toilet cover closure device. In FIG. 1, the toilet tank, denoted by reference numeral 10, is shown partially in cross section to reveal the internal mechanism. Shown schematically is a flush handle 12 having integral therewith a lever 14 connected to a vertical rod 16 in turn connected to a rubber plunger 18 which closes the drain opening 20 leading to the toilet bowl 22. When the toilet is flushed, plunger 18 is raised, allowing water 24 in tank 10 to escape through opening 20 to toilet bowl 22. As the water level is lowered, float 26 is lowered until water inlet valve 28 is opened, allowing water from inlet pipe 30 to enter tank 10. The above-described structure is conventional in the prior art.

Figure 2:
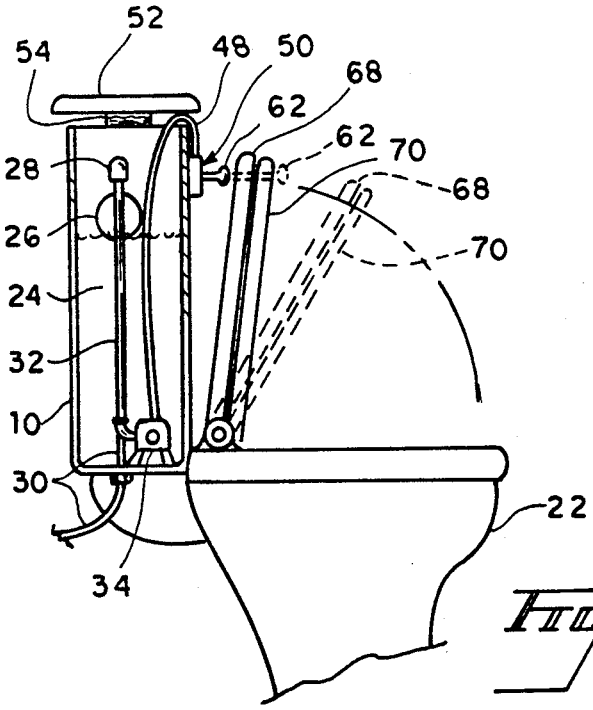
FIG. 2 is a cross-sectional side view of the toilet cover closure device of FIG. 1 in an operated state.
Figure 3:
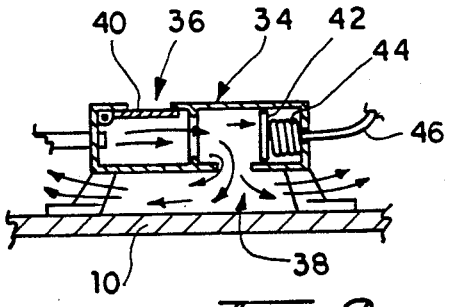
FIG. 3 is a cross-sectional view showing the water release valve arrangement at the bottom of the toilet tank for operating the toilet cover closure device of FIG. 1.

The instant invention involves a toilet cover closure device which is operated by the pressure of the incoming water whenever a toilet is flushed. The water entering inlet pipe 30 flows through inlet valve 28 to pipe 32 which carries the water down to a water release valve unit 34 which includes two release valves 36 and 38. Valve flap 40 is normally open when tank 10 is full of water 24, as shown in FIG. 1. When water inlet valve 28 is opened to allow water to flow through pipes 30 and 32, the pressure of the flowing water pushes valve flap 40 to the closed position and also pushes piston head 42 to the right, thereby opening lower release valve 38 and allowing water 24 to enter tank 10, as shown by the arrows in FIG. 3. Piston head 42, biased to the left in FIG. 1 by spring 44, is connected to a flexible wire 46 which travels in guide sheath 48 (bowden wire) and which is connected at the other end to the cover closure mechanism denoted by reference numeral 50. To allow flexible wire 46 and guide sheath 48 to exit tank 10 without being pinched, tank cover 52 is raised by spacers 54 as shown in FIGS. 1 and 2.

Figure 4:
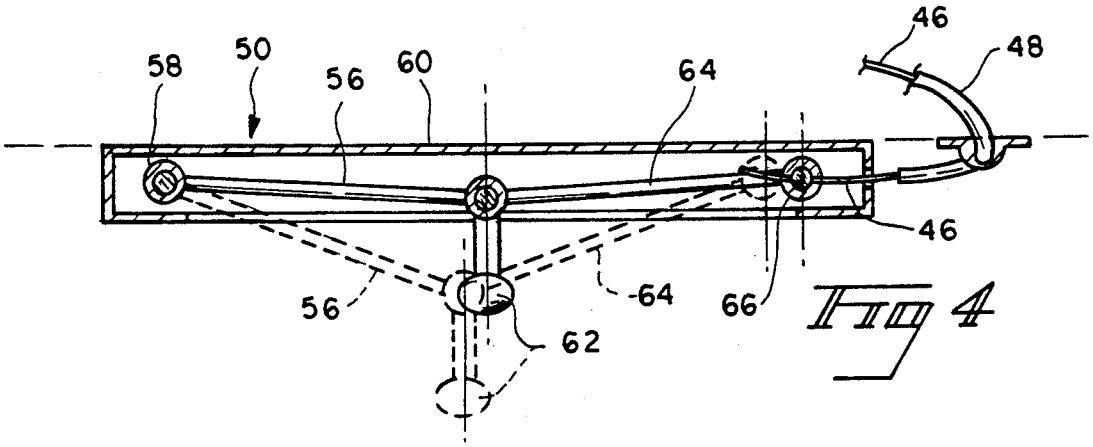
FIG. 4 is a cross-sectional top view showing the toilet cover closure mechanism, including the push pin in both the inoperative and operative positions.

As more clearly shown in FIG. 4, cover closure mechanism 50 comprises a first rod 56 pivoted at one end 58 to slotted enclosure 60 and at push pin 62 to a second rod 64 which is connected at end 66 to flexible wire 46. As wire 46 is shifted because of water pressure, end 66 of second rod 64 is shifted to the left in FIGS. 1 and 4, thereby shifting pin 62 outwardly away from tank 10 towards conventional cover 68 to move cover 68, and seat 70 connected thereto if seat 70 happens to be in an upright position, toward the closed position in a controlled manner to be described later. When tank 10 has been filled with water 24, float 26 has risen to a height sufficient to close water inlet valve 28. This in turn relieves the water pressure pushing against valve flap 40 and piston head 42. Valve flap 40 opens, and spring 44 pushes piston head 42 to the left, thereby closing lower release valve 36 and returning push pin 62 to the inoperable position.

Figure 7:
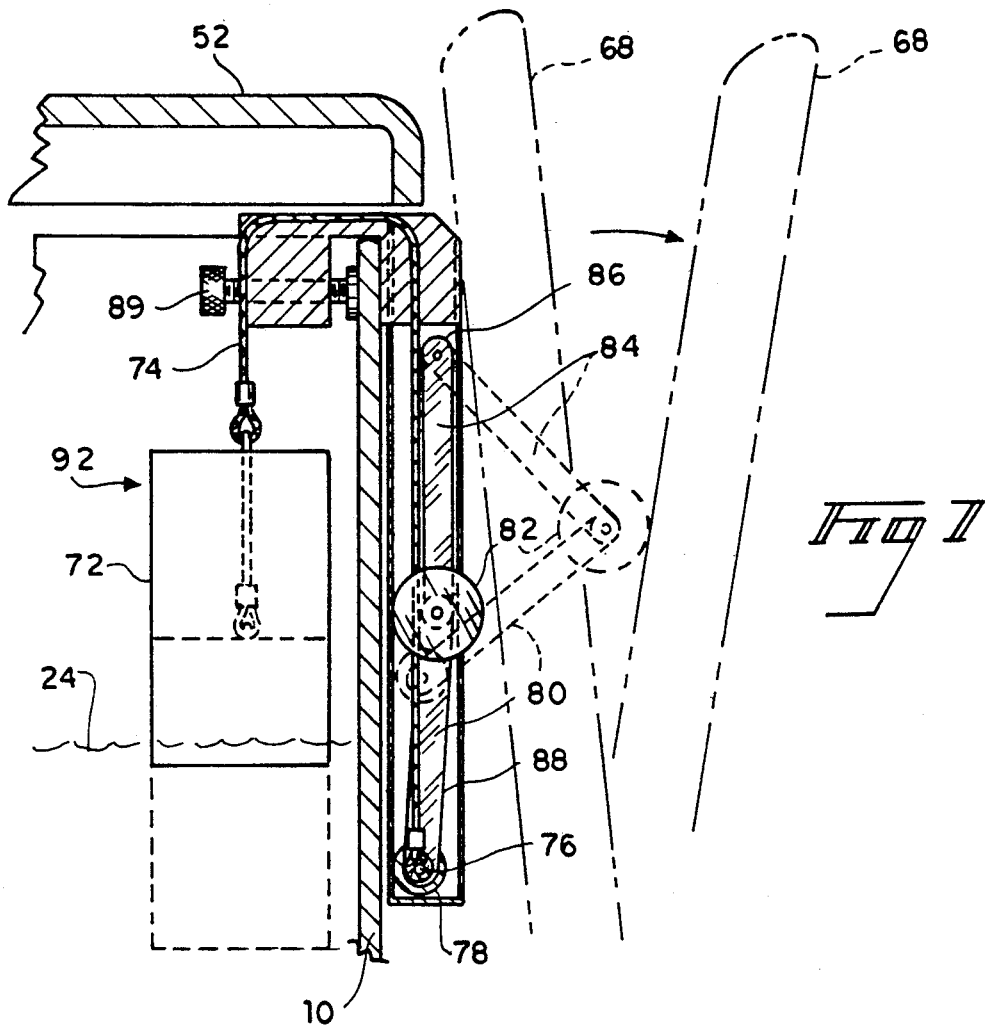
FIG. 7 is a cross-sectional side view of an alternative toilet cover closure device.
Figure 8:
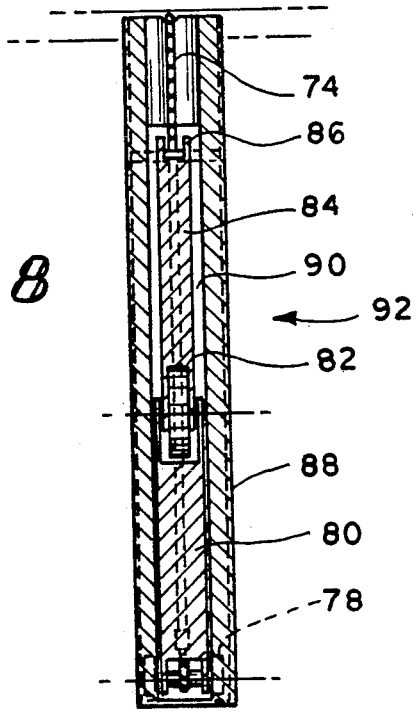
FIG. 8 is a front view of the alternative toilet cover closure device of FIG. 7.

FIGS. 7 and 8 show a second embodiment of a toilet cover closure mechanism 92 actuated when a toilet is flushed. In FIG. 7, there is shown a 1-lb. sealed container or float 72 which floats on top of water 24 in toilet tank 10. The float 72 is connected by means of a cord 74 to the axle 76 of a bottom wheel or pulley 78 mounted on a first lever 80 pivoted at pivot pin 82 to a second lever 84 fixedly pivoted at the other end 86 to enclosure 88 attached to water tank 10 by lock screw 89. When the toilet is flushed, float 72 follows the level of water 24 towards the bottom of tank 10, simultaneously pulling on cord 74 to move bottom wheel or pulley 78 upwardly in guide slot 90 in enclosure 88, thereby moving pivot pin 82 outwardly to push cover 68 towards the closed position. Toilet cover closure mechanism 92 is mounted on toilet tank 10 by means of a lock screw 94 as shown in FIG. 7. Alternatively, toilet cover closure mechanism 92 may be mounted by means of an adhesive or other conventional fastening means, as in toilet cover closure mechanism 50.

Figure 5:
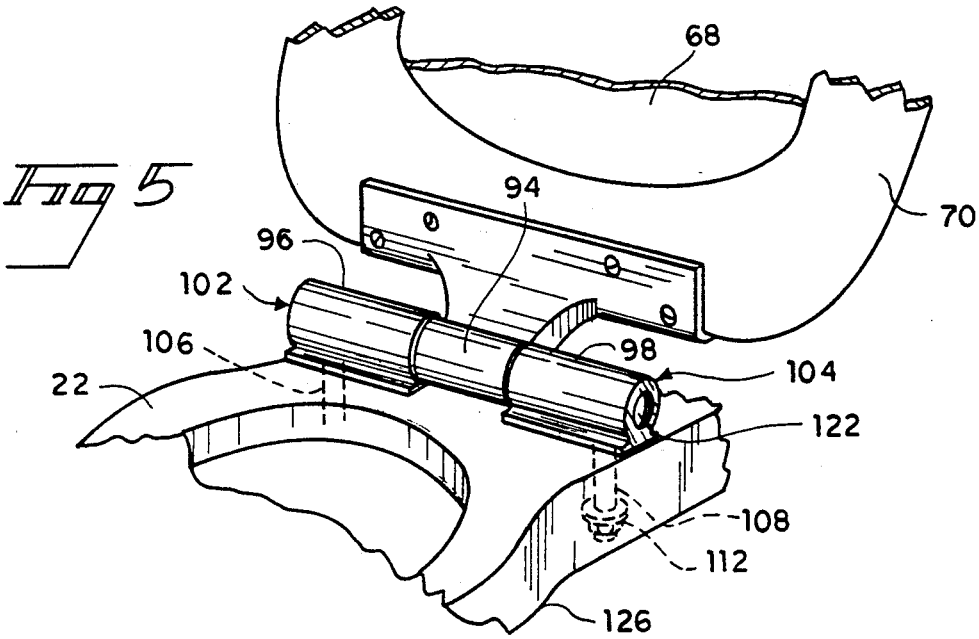
FIG. 5 is a perspective view showing the toilet cover mounting.
Figure 6:
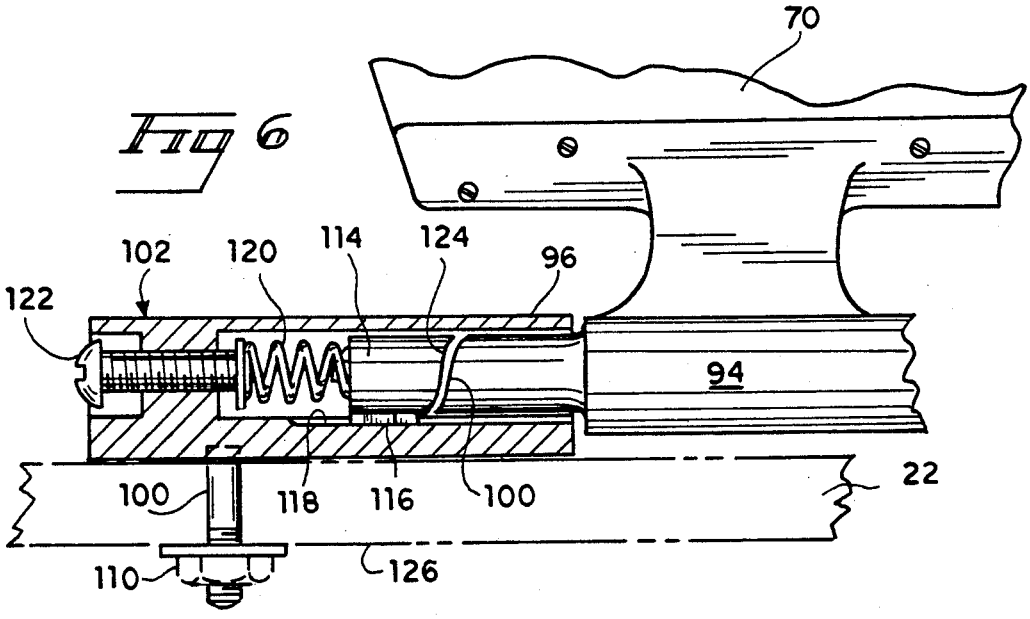
FIG. 6 is a front cross-sectional view showing the dampening mechanism for lowering the toilet cover in a controlled manner.

The means for lowering cover 68 in a controlled manner through the action of a cover dampener is shown in FIGS. 5 and 6. As shown, toilet cover pivot shaft 94 is mounted to rotate in bearings 96 and 98, which also limit the side-wise movement of seat cover 68 relative to toilet bowl 22. The respective ends of shaft 94 are configured to present an outwardly directed face cam 100, only one being shown in FIG. 6. Bearings 96 and 98 are formed as internal cylindrical surfaces at one end, respectively, of dampening means 102 and 104, attached to toilet bowl 22 by bolts 106 and 108 and nuts 110 and 112, which bear against the bottom surface 126 of a rim on toilet bowl 22.

FIG. 6 shows left dampening means 102 in cross section. The outer casing of dampening means 102 is a cylinder which slidably houses a face cam element 114 which co-acts with face cam 100 to control the rate of fall of toilet cover 68. Face cam element 114 includes a key 116 which slides in keyway 118. Compression spring 120 provides a force pushing face cam element 114 towards face cam 100, the amount of force being adjustable by screw 122. In operation, as toilet cover 68 starts its movement towards the closed position, face cam 100 will bear against a corresponding face cam 124 on face cam element 114 which is pushed in a direction to compress spring 120. Right dampening means 104 functions in the same manner. Together, dampening means 102 and 104 regulate the rate of fall of cover 68 towards toilet bowl 22.

Figure 9:
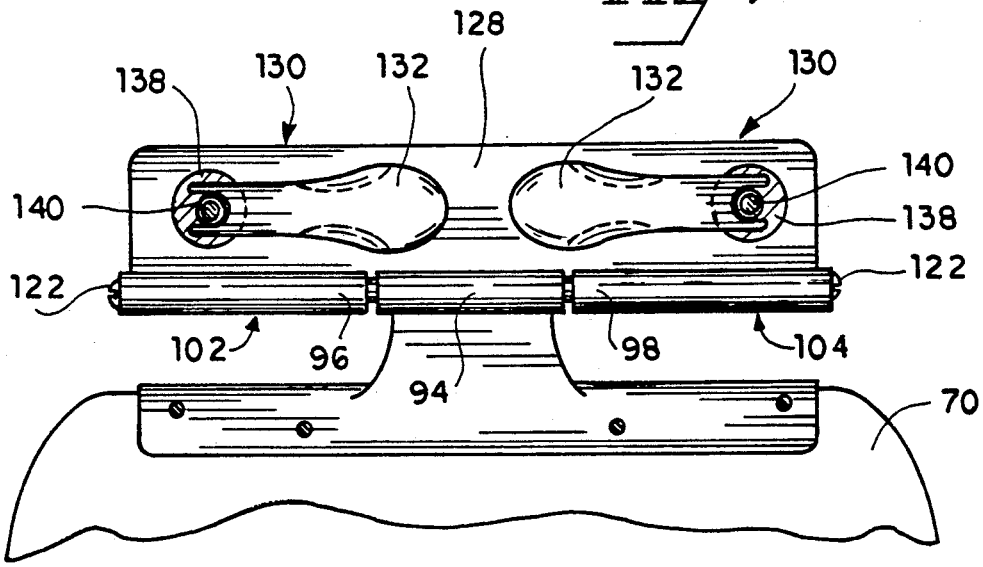
FIG. 9 is a top view of a quick release means for quickly and easily removing a toilet seat and a toilet seat cover from a toilet bowl.
Figure 10:
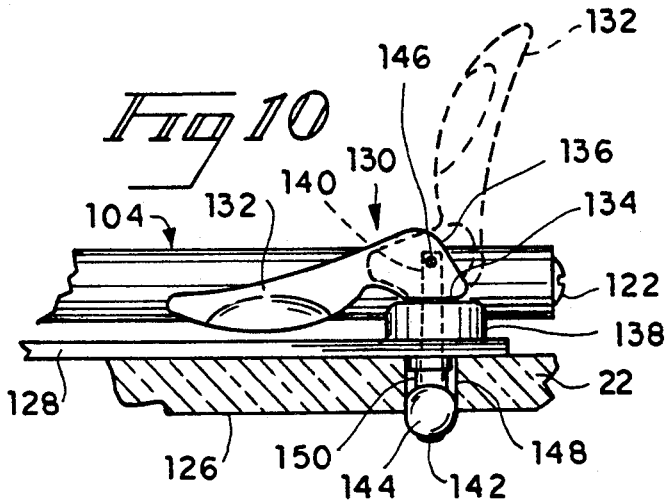
FIG. 10 is a rear view of the quick release means of FIG. 9.
Figure 11:
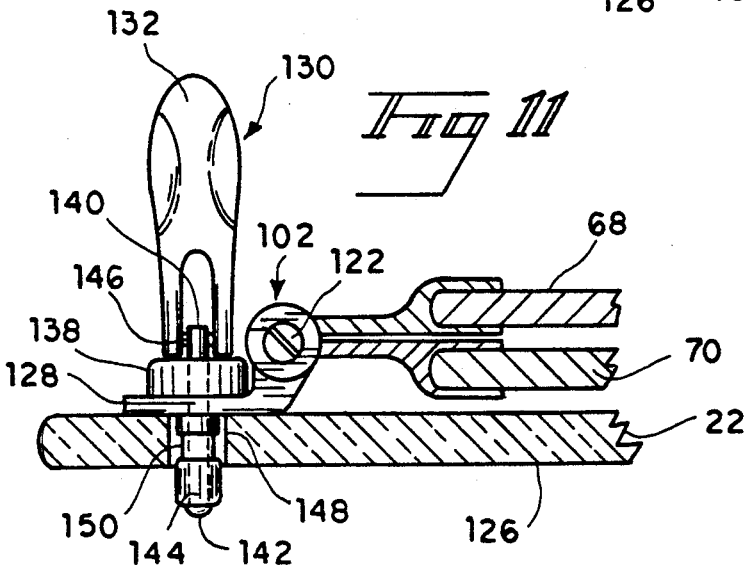
FIG. 11 is a side view of the quick release means of FIG. 9.

FIGS. 9, 10 and 11 show a modification of the means to mount a toilet seat 70 and a toilet seat cover 68 on a toilet bowl 22. Elements 94, 102, 104 and 122 are the same as shown in FIGS. 5 and 6 with the exception that they are mounted on a plate 128 which in turn is attached to toilet bowl 22 by quick release means 130. As shown, quick release means 130 comprises a handle 132 having two cam faces 134 and 136 which bear under spring bias against a surface element 138 to hold handle 132 in one of two positions. Handle 132 is connected at pivot 146 to rod 140 having a head 142 which bears against hollow elongated elastic member 144. In the vertical position of handle 132 shown in FIG. 11, cam face 136 bears against surface element 138, and rod 140 together with rod head 142 is at its lowest position, with elastic member 144 being in a relaxed state disengaged from the wall of circular opening 148. In this condition quick release means 130, together with conventional toilet seat 70, toilet seat cover 68 and dampening means 102, 104, are easily removed from toilet bowl 22 for cleaning or for substitution of another toilet seat and/or toilet seat cover.

In the horizontal position of handle 132 shown in FIGS. 9 and 10, cam face 134 bears on surface element 138, thereby raising rod 140 and rod head 142 to a higher level relative to surface elements 138. Element 150 acts as a fixed washer. The vertical movement of rod head 142 toward fixed washer 150 squeezes and distorts elastic member 144 in the manner shown in FIG. 10, whereby the outer surface of elastic member 144 bears against the cylindrical wall of opening 148 to lock the quick release means 130 and the attached toilet seat 70, toilet seat cover 68, and dampening means 102, 104 to the toilet bowl 22. As an alternative, elastic member 144 may extend below and bear against bottom surface 126 on the rim of toilet bowl 22 through opening 148.

While it will be apparent that the preferred embodiment of the invention herein disclosed is well calculated to fulfill the objects above-stated, it will be appreciated that the invention is susceptible to modification, variation and change without departing from the proper scope or fair meaning of the subjoined claims.

I claim:

1. A toilet cover closure device comprising:

a toilet cover pivotally mounted on a toilet bowl by fastening means to enable said cover to selectively assume a horizontal position and a substantially vertical position;

dampening means to control the descent of said cover from a substantially vertical position to a horizontal position, said dampening means being connected to said fastening means, said dampening means comprising;

a toilet cover pivot shaft connected to said toilet cover and rotatable in a pair of bearings;

a left cylinder means and a right cylinder means suitably attached to said fastening means for housing respectively;

said pair of bearings, a slidable left face cam element, a slidable right face cam element, left and right spring means for urging said slidable face cam elements toward said pivot shaft, and left and right adjusting screw means for biassing said left and right spring means against said slidable face cam elements;

said toilet cover pivot shaft having a left and right ends configured as face cams for co-acting with corresponding said slidable left and right face cam elements;

a water tank connected to a water inlet source and to said toilet bowl to provide a source of water to flush said toilet bowl, said water tank containing a water inlet valve controlled by a float, a plunger connected to a flush handle by a lever and a rod for controlling the release of the water from the tank to the toilet bowl; and a toilet cover closure means mounted on said water tank responsive to the flow of water in the water tank during a flushing operation for urging said toilet cover from the substantially vertical position towards the horizontal position; whereby during a flushing operation a toilet cover is urged from the substantially vertical position towards the horizontal position as a result of actuating said flush handle, and when said toilet cover moves from the substantially vertical position towards the horizontal position said slidable left and right face cam elements are forced outwardly against the bias of said left and right spring means, thereby controlling the rate of descent of said toilet cover towards said toilet bowl.

2. A toilet cover closure device as in claim 1, further comprising:

a pipe means for connecting said water inlet valve at the top of said water tank to a water release valve unit at the bottom of said water tank;

said water release valve unit including an upper release valve having a valve flap means for selectively closing said upper release valve, a lower release valve, a piston means for selectively closing said lower release valve and connected to one end of a flexible wire enclosed in a guide sheath, and a spring means for urging said piston means to a position closing said lower release valve when said water tank is filled with water; and a cover closure means for urging said toilet cover from the substantially vertical position towards the horizontal position, said cover closure means being mounted externally of said water tank and connected to a second end of said flexible wire; whereby when said flush handle is actuated, water enters said pipe means and said water release valve unit forcing said valve flap means to close said upper release valve, and forcing said piston means and flexible wire to an actuated position opening said lower release valve and activating said cover closure means.

3. A toilet cover closure device as in claim 2 wherein said cover closure means comprises:

an enclosure;

a first rod pivotally mounted at one end within said enclosure means;

a second rod pivotally connected at one end to a second end of said first rod and connected at the other end to said flexible wire means; and a push pin connected to said first and second rod means; whereby when said flexible wire is moved to said actuated position said first rod and said second rod in concert with said push pin are moved toward said toilet cover to urge said toilet cover from the substantially vertical position toward the horizontal position.

4. A toilet cover closure device as in claim 2, said fastening means comprising:

a support plate for mounting a left and right quick release means enabling quick and easy removal of said toilet cover and a toilet seat from said toilet bowl, each of said left and right quick release means including:

a handle having a first and a second cam;

a surface element means mounted on said support plate for cooperating with said first cam and said second cam;

a rod connected to said handle at one end and having an enlarged head at the other end;

said rod being slidable through an opening in said surface element means and a support washer fixed to said support plate on a side opposite to the side mounting said surface element means; and an elastic means mounted between said support washer and said enlarged head, said elastic means being cylindrical in configuration with a cylindrical opening therethrough along a longitudinal axis of said elastic means to accommodate said rod;

said washer, said elastic means, and said enlarged head extending through a cylindrical opening in said toilet bowl when mounting said toilet cover on said toilet bowl; whereby when said handle is moved from a vertical release position to a horizontal lock position said elastic member is squeezed between said washer and said enlarged head, thereby forcing a cylindrical sidewall of said elastic means to bulge against a portion of said toilet bowl to lock said toilet cover onto said toilet bowl.

5. A toilet cover closure device as in claim 1, further comprising:

a sealed, weighted float within said water tank;

a toilet cover closure means connected to said water tank by a lock screw for urging said toilet cover towards the horizontal position;

a cord connected between said float and an axle at a first lower end of a first lever;

a second lever pivotally connected at one end to an enclosure means for housing said toilet cover closure means and at the other end to a second end of said first lever; and a pusher pivot pin connected between said first lever and said second lever; whereby when said flush handle is actuated said weighted float is lowered with the water level in the water tank, said cord pulls on said axle to move said pusher pivot pin towards said toilet cover to urge said toilet cover from the substantially vertical position to the substantially horizontal position.

6. A toilet cover closure device as in claim 1, said fastening means comprising:

a support plate for mounting a left and right quick release means enabling quick and easy removal of said toilet cover and a toilet seat from said toilet bowl, each of said left and right quick release means including:

a handle having a first and a second cam;

a surface element means mounted on said support plate for cooperating with said first cam and said second cam;

a rod connected to said handle at one end and having an enlarged head at the other end;

said rod being slidable through an opening in said surface element means and a support washer fixed to said support plate on a side opposite to the side mounting said surface element means; and an elastic means mounted between said support washer and said enlarged head, said elastic means being cylindrical in configuration with cylindrical opening therethrough along a longitudinal axis of said elastic means to accommodate said rod;

said washer, said elastic means, and said enlarged head extending through a cylindrical opening in said toilet bowl when mounting said toilet cover on said toilet bowl; whereby when said handle is moved from a vertical release position to a horizontal lock position said elastic member is squeezed between said washer and said enlarged head, thereby forcing a cylindrical sidewall of said elastic means to bulge against a portion of said toilet bowl to lock said toilet cover onto said toilet bowl.

7. A pivotal damper for a toilet cover comprising:

a toilet cover pivot shaft means connected to a toilet cover for pivotally mounting said toilet cover to a toilet bowl and rotatable in a pair of bearing means, a left cylinder means and a right cylinder means suitably attached to said toilet bowl for housing respectively;

said pair of bearings, a slidable left face cam element, a slidable right face cam element, left and right spring means for urging said slidable face cam elements toward said pivot shaft means, and left and right adjusting screw means for biassing said left and right spring means against said slidable face cam elements;

said toilet cover pivot shaft means having a left and right ends configured as face cams for co-acting with corresponding said slidable left and right face cam elements; whereby when said toilet cover moves from the substantially vertical position towards the horizontal position said slidable left and right face cam elements are forced outwardly against the bias of said left and right spring means, thereby controlling the rate of descent of said toilet cover towards said toilet bowl.

8. A quick release fastening means for a toilet seat and a toilet cover comprising:

a support plate for mounting a left and right quick release means enabling quick and easy removal of said toilet cover and toilet seat from a toilet bowl, each of said left and right quick release means including:

a handle having a first and a second cam;

a surface element means mounted on said support plate for cooperating with said first cam and said second cam;

a rod connected to said handle at one end and having an enlarged head at the other end;

said rod being slidable through an opening in said surface element means and a support washer fixed to said support plate on a side opposite to the side mounting said surface element means; and an elastic means mounted between said support washer and said enlarged head, said elastic means being cylindrical in configuration with a cylindrical opening therethrough along a longitudinal axis of said elastic means to accommodate said rod;

said washer, said elastic means, and said enlarged head extending through a cylindrical opening in said toilet bowl when mounting said toilet cover on said toilet bowl; whereby when said handle is moved from a vertical release position to a horizontal lock position said elastic member is squeezed between said washer and said enlarged head, thereby forcing a cylindrical sidewall of said elastic means to bulge against a portion of said toilet bowl to lock said toilet cover onto said toilet bowl.

* * * * *